United States Patent [19]

Shepley et al.

[11] Patent Number: 4,697,350

[45] Date of Patent: Oct. 6, 1987

[54] COMBINATION ARROW QUIVER AND SIGHT SUPPORT MOUNT

[75] Inventors: Pete Shepley; Richard Johnston; Allan F. Smith, all of Tucson, Ariz.

[73] Assignee: Precision Shooting Equipment Company, Tucson, Ariz.

[21] Appl. No.: 920,034

[22] Filed: Oct. 17, 1986

[51] Int. Cl.[4] ..... F41B 5/00

[52] U.S. Cl. ..... 33/265; 124/24 A

[58] Field of Search ..... 124/87, 41 R, 23 A, 124/24 A; 33/265

[56] References Cited

U.S. PATENT DOCUMENTS 4,621,606 11/1986 Toth ..... 124/24 A

OTHER PUBLICATIONS

The "QD" Hunting Quiver & Sight System Archery, 6/78, p. 5.

*Primary Examiner*—Harry N. Haroian

*Attorney, Agent, or Firm*—Jack E. Dominik

[57] ABSTRACT

A combination bracket for securing to a bow. The bracket in a unitary and properly spaced fashion, provides for the mounting of a bow quiver, and also a sight for the archer to use in aiming the bow. More specifically the unit includes a central combination bracket mounting segment from which the sight bracket extends in one direction and the bow quiver bracket extends in another direction. The unit is symmetrical about a horizontal axis. This symmetrical configuration makes the mount suitable for left-hand or right-hand applications. The unit may be produced by injection molding of plastic, machining, or casting by the various known techniques.

4 Claims, 8 Drawing Figures

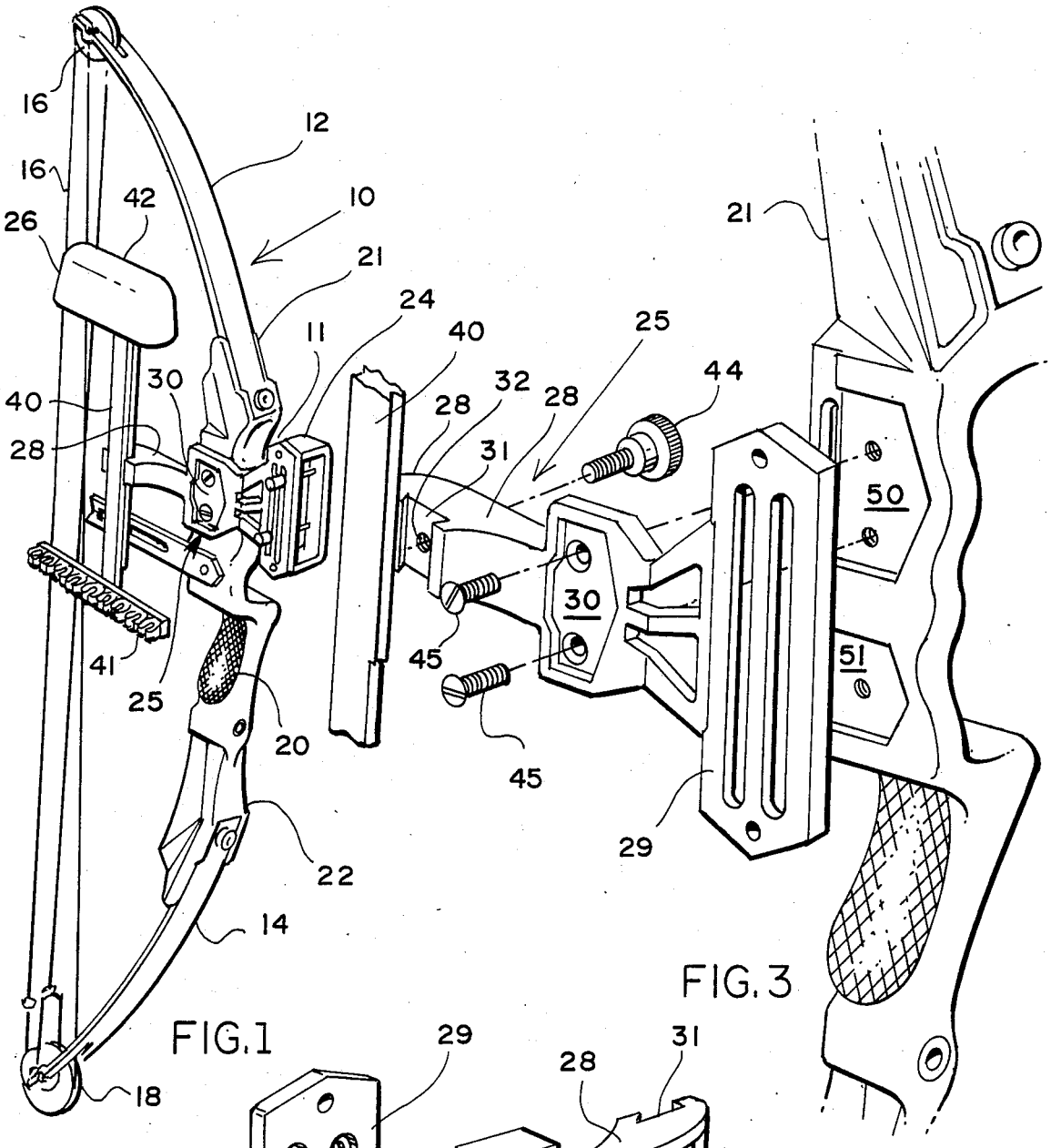
FIG. 1
FIG. 3
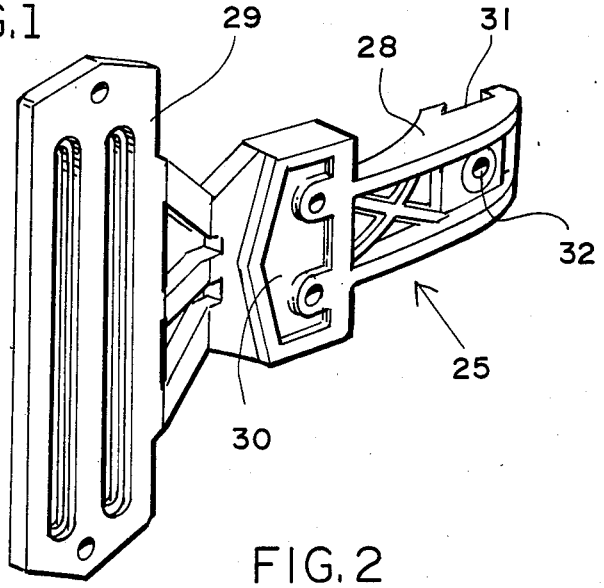
FIG. 2

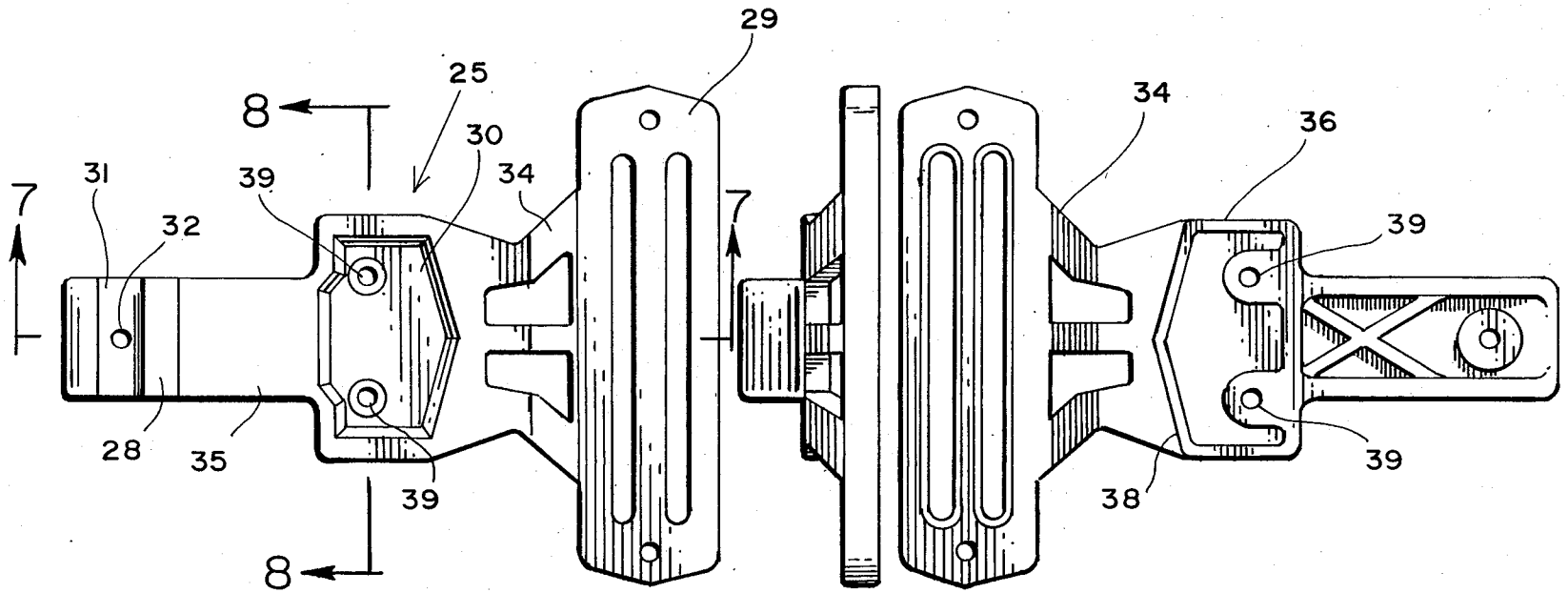
FIG. 6
FIG. 5
FIG. 4
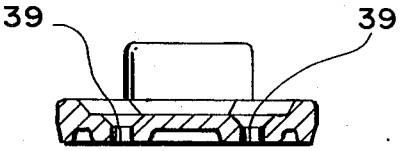
FIG. 8
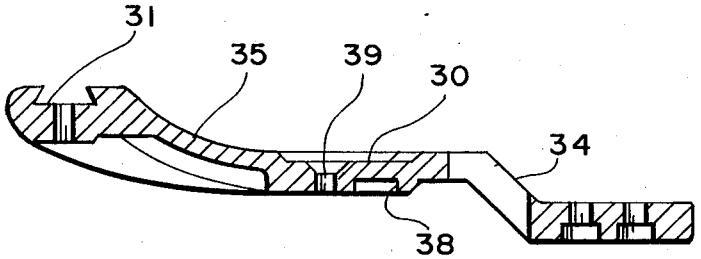
FIG. 7

COMBINATION ARROW QUIVER AND SIGHT SUPPORT MOUNT

BACKGROUND OF THE INVENTION

1. Field of the Invention

The present invention relates primarily to the archery field, and more specifically to a mount for statically and dynamically conveniently securing a bow quiver and a sight to a typical hunting bow. The same may be used in a bow not destined for hunting, as well with equal ease and convenience to the archer.

2. Summary of the Prior Art

Bows for hunting, whether of the compound or long bow variety, have been known for years. When archers proceed on the hunt, they normally utilize a bow sight, as well as a quiver to store their arrows. More recently quivers have been mounted to a bow, but in a rather haphazard manner. Similarly the bow sight has been mounted to a bow but without coordination with the bow quiver. In both instances the position is dictated by whatever position on the bow a mount can be made. The present invention has to do with a combination mount for both a sight and a bow quiver which secures the same in convenient spaced relationship to the arrow rest.

SUMMARY OF THE INVENTION

The present invention is directed to a combination bracket for securing to a bow. The bracket in a unitary and properly spaced fashion, provides for the mounting of a bow quiver, and also a sight for the archer to use in aiming the bow. More specifically the unit includes a central combination bracket mounting segment from which the sight bracket extends in one direction and the bow quiver bracket extends in another direction. The unit is symmetrical about a horizontal axis. This permits either right-hand or left-hand usage. The unit is also substantially uniformly offset from the mounting segment in one direction for the bow quiver mount, and in the opposite direction for the sight mount. This permits better spacing and minimizes interference.

In view of the foregoing it is a principal object of the present invention to provide a combination bow sight and bow quiver mount which, through a single unit, permits the uniformly spaced mounting of both the bow sight and a quiver susceptible of usage in either a right-hand or left-hand configuration.

Another object of the present invention is to provide a combination bow sight and quiver mount which actually reduces the inherent manufacturing cost and number of components in the mounting of both a bow sight and a quiver to a bow, particularly of the hunting category.

Yet another object of the present invention is to furnish a buyer with a standard bow with a combination bow sight and quiver mount which can be retrofitted to an existing bow.

BRIEF DESCRIPTION OF THE DRAWINGS

Further objects and advantages of the present invention will become apparent as the following description of an illustrative embodiment proceeds, taken in conjunction with the accompanying drawings, in which:

FIG. 1 is a perspective view of a hunting bow of the compound variety illustrating in perspective how the subject combination mount is utilized to secure both the bow quiver and the sight to the bow;

FIG. 2 is an enlarged perspective view of the combination mount member;

FIG. 3 is an enlarged partially broken perspective exploded view illustrating the relationship between the combination bow quiver and sight mount and the bow;

FIG. 4 is a front elevation of the subject combination mounting bracket;

FIG. 5 is an end view of the embodiment of the subject bracket as shown in FIG. 4;

FIG. 6 is a rear view of the same bracket as shown in FIGS. 4 and 5;

FIG. 7 is a longitudinal transverse sectional view of the bracket shown in FIG. 4 taken along section line 7—7 of FIG. 4; and FIG. 8 is a further sectional view of the bracket taken along section line 8—8 of FIG. 4.

DESCRIPTION OF A PREFERRED EMBODIMENT

Turning now to FIG. 1, it will be seen that an archer's bow 10 is shown having a handle riser 11 at a midportion, and terminating in an upper limb 12 and a lower limb 14. The bow string 15 is strung between the upper wheel 16 and the lower wheel 18. Central to the riser and bow limb mounting portions of the bow is a handgrip 20. The upper limb mount 21 is above the handgrip 20, and the lower limb mount therebeneath. More specifically, in accordance with the invention, it will be seen that a bow sight 24 is positioned forwardly of the handgrip 20, and a bow quiver 26 positioned rearwardly thereof.

The combination bracket 25, more specifically as shown in FIGS. 2 and 3, includes a bow quiver bracket segment 28, and a sight bracket segment 29. The subject segments merge at a combination bracket mounting segment 30. A dovetail slot 31 is provided in the bow quiver bracket segment 28, and a bow quiver support screw hole 32 is positioned therein. A sight segment arm 34 and a quiver segment arm 35 extend from the combination bracket mounting segment 30. The sight bracket segment is provided with longitudinal slots of the normal variety for mounting a bow sight to slide upwardly or downwardly in accordance with the setting of the sight.

It should also be noted in FIG. 6 that a mounting shoe is provided at the base of the combination bracket mounting segment 30, and the mounting shoe is proportioned to be secured to a mount. Mounting holes 39 are conveniently provided interiorly of the combination bracket mounting segment 30.

Reverting now to FIG. 3, it will be seen that a bow quiver support arm 40 terminates at its lower portion with an arrow shaft holder 41, and at its upper portion with an arrow hood. The quiver support arm screw 44, particularly as shown in FIG. 3, is used to engage the bow quiver support arm 40. The mounting segment screws 45 are used to secure the combination bracket mounting segment 30, and more specifically its shoe 36, against the sight quiver recess 50 provided in the bow riser handle 11. Also to be noted in FIG. 3 is the positioning of a mounting portion for an overdraw mechanism or arrow rest, the mounting portion being designated by reference numeral 51. In certain bows a quiver recess 50 may not be found. In this instance the combination bracket 25 is secured directly to a flat surface on the conventional bow handle. Nonetheless, the bracket 25 is sufficiently adaptable to either use or may be otherwise adapted for mounting.

In greater detail as will be seen in FIGS. 4–8, particularly FIGS. 4 and 5, the combined mounting bracket assembly 25 is symmetrical in plan view about its longitudinal axis, or more specifically the axis which substantially parallels the flight of the arrow. As generally set forth above, this construction permits left-hand or right-hand mounting. Similarly, as illustrated more specifically in FIG. 7, the sight mount portion 29 is offset from the center line of the line passing through the shoe 36. This symmetrical relationship, or equal offsetting relationship in combination with the symmetrical relationship, provides for a stability in use where the bow quiver must be on the opposite side of the bow from the flight of the arrow, whereas the sight must be substantially in the line of flight of the arrow. By positioning the elements of the bracket 25 as just recited, this desirable result is achieved in a single unit which, when mounted to a sight quiver recess or to the normally tapered holes 50 on the bow, secures the same permanently and the hunter may, at his choice, remove the bow quiver and still have a balanced sight, or remove the sight pins only and still have a balanced bow quiver, or dispense with both. In addition, interchangeability of sights is readily provided for, and the same is true with regard to bow quivers depending upon whether hunting arrows or target arrows may be used.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification, and the appended claims.

What is claimed is

1. A combination quiver and sight mount for use on an archer's bow having a mount portion on the grip/-handle/riser portion thereof between the two limbs, comprising, a single unitary mounting bracket, said mounting bracket having centrally thereof a bracket mounting segment, a bow quiver bracket segment extending in one direction from said bracket mounting segment and secured to a quiver segment arm, a removably secure and vertical adjustment means on the bracket engaging the quiver segment arm and permitting vertical adjustment of the arm, a bow sight mounting bracket extending in the other direction and secured to a bow sight mounting arm, a mounting shoe at the lower portion of the bracket mounting segment proportioned to engage the mount portion of the bow, said combination mount being characterized by being symmetrical in plan view about its longitudinal axis substantially parallel with the flight of an arrow, and, said quiver mounting bracket and said sight mounting bracket being offset substantially the same opposite directions from the mounting bracket segment, whereby the bow sight is mounted for positioning on one side of the archery bow handle riser portion, and means are provided for securing a bow quiver at the opposite side, thereby positioning both members in a substantially symmetrical and balanced fashion around the bow handle riser and handle of the bow.

2. In the combination bracket of claim 1 above, said bow quiver mounting member being a dovetail slot for receiving a bow quiver support arm, and means for removably and adjustably securing such bow quiver support arm within the bow quiver support bracket.

3. In the combination bracket of claim 1 above, said bow sight member having sight receiving means, said sight receiving means being substantially perpendicular to the flight of an arrow and proportioned for removably receiving and adjustably receiving a sight.

4. In the combination bow quiver and sight bracket of claim 1, a bow to which the bow quiver and sight bracket is mounted, a sight quiver recess in said bow, said combination bracket mounting segment at the median portion having a shoe and a pair of holes, and means for removably securing the same to the sight quiver recess with the shoe nestingly engaging in said sight quiver recess.

* * * * *